United States Patent [19]

Larinoff

[11] Patent Number: 4,926,931

[45] Date of Patent: May 22, 1990

[54] FREEZE PROTECTED, AIR-COOLED VACUUM STEAM CONDENSERS

[76] Inventor: Michael W. Larinoff, 370 Holly Hill Rd., Oldsmar, Fla. 34677

[21] Appl. No.: 409,952

[22] Filed: Sep. 15, 1989

Related U.S. Application Data

[63] Continuation of Ser. No. 270,656, Nov. 14, 1988, abandoned.

[51] Int. Cl.[5] ..... F28B 1/06; F28B 9/10

[52] U.S. Cl. ..... 165/111; 165/113; 165/114; 165/144; 165/176; 165/900; 165/917; 60/693

[58] Field of Search ..... 165/113, 114, 917, 111, 165/900, 144; 60/693, 691

[56] References Cited

U.S. PATENT DOCUMENTS

| | | | |
|---|---|---|---|
| 2,205,292 | 6/1940 | Howard | 165/114 |
| 3,338,052 | 8/1967 | Holden | 165/114 |
| 3,612,172 | 10/1971 | Dohnt | 165/114 |
| 3,705,621 | 12/1972 | Schoonman | 165/111 |
| 3,887,002 | 6/1975 | Schoonman | 165/900 |
| 4,168,742 | 9/1979 | Kluppel et al. | 165/114 |
| 4,202,405 | 5/1980 | Berg | 165/111 |
| 4,513,813 | 4/1985 | Zanobini | 165/111 |

*Primary Examiner*—Albert W. Davis, Jr.

*Attorney, Agent, or Firm*—Dominik, Stein, Saccocio, Reese, Colitz & Van Der Wall

[57] ABSTRACT

An improved steam power system comprising a turbine for converting steam energy into mechanical energy upon expansion of steam therein, a boiler for generating steam to be fed to the turbine, and a conduit arrangement coupling the boiler to the turbine input and then coupling the turbine exhaust to the boiler through air cooled steam condensing mechanisms, the condensing mechanisms including a plurality of U-shaped tubes through which the expanded steam flows and is condensed; front header means at the input ends of the tubes located in the cooler ambient air exposed regions of the tubes for receiving exhaust steam from the turbine; rear header means at the output ends of the tubes located in the warmer unexposed regions of the tubes for receiving condensate and non-condensible gasses; and means in the rear headers to remove non-condensible gasses from the rear headers, the tubes being designed and constructed to protect the tubes from freezing for lack of steam by employing a tube arrangement that flows steam from the input headers not only for its exposed single row condensing duty but for a second row as well, the second row being located in the heated and protected unexposed center of the tube bundles thus insuring an additional supply of steam from the inner rows for the exposed tubes in the top and bottom faces of the bundles which require the most protection.

7 Claims, 7 Drawing Sheets

FREEZE PROTECTED, AIR-COOLED VACUUM STEAM CONDENSERS

This is a determination of copending Ser. No. 270,656 filed on 11-14-88 now abandoned.

BACKGROUND OF THE INVENTION

This invention relates to improved freeze protected, air-cooled, vacuum steam condensers serving steam turbine power cycles or the like and, more particularly, to improved apparatus for condensing steam or other vapors in extremely cold climates and draining the condensate over a wide range of steam loads, steam pressures and ambient air temperatures and for also completely removing the steam-transported, undesirable, non-condensible gasses that migrate and collect in the rear headers of the steam condensing tube bundles.

DESCRIPTION OF THE BACKGROUND ART

One technique for generating mechanical energy is the use of a turbine, boiler and an array of coupling conduits. Water is first converted to steam in the boiler. The steam is then conveyed to the turbine wherein the steam is expanded in its passage through rotating blades thereby generating shaft power. An array of conduits couple the turbine and the boiler and also define a working fluid return path from the turbine back to the boiler through steam condenser mechanisms in a continuing cycle of operation.

Steam condenser mechanisms include air-cooled vacuum steam condensers which may be considered as being comprised of four basic elements or systems: the steam condensing system, the air moving system, the condensate drain system and the non-condensible gas removal system.

The main problems plaguing the industry today are in the condensate drain and non-condensible gas removal systems that result in condensate freezing followed by the rupturing of bundle drains and heat exchanger tubes. Another major freezing problem is that caused by cold wind gusts blowing over exposed areas of bundle tubes that may have a limited supply of steam flow. The reasons for their failures can be traced to faulty condensate-drain hydraulic-design, the trapping of non-condensible gasses in the rear headers of the heat exchanger bundles, insufficient freeze protection items and inadequate steam flow for the protection of terminal tube ends in rows exposed to the cold ambient air. The problems are aggravated further by the wide range of plant operating conditions imposed upon the equipment and by low ambient air temperatures coupled with high winds.

Various approaches are disclosed in the patent literature to improve the efficiency, hydraulics, freeze protection and control of air-cooled vacuum steam condensers and related devices. By way of example, note U.S. Pat. Nos. 2,217,410 to Howard and 3,289,742 to Niemann. These patents disclose early versions of heat exchangers for use in turbine systems. Other patents relating to improving air-cooled system steam condensers include U.S. Pat. Nos. 2,247,056 to Howard and 3,429,371 to Palmer. These patents are directed to control apparatus for accommodating pressure variations. In addition, U.S. Pat. No. 4,585,054 to Koprunner is directed to a condensate draining system. The linear arrangement of tubes in A-frame steam condensers is disclosed in U.S. Pat. Nos. 4,177,859 to Gatti and 4,168,742 to Kluppel while U-shaped tubes are disclosed in U.S. Pat. Nos. 3,705,621 and 3,887,002 to Schoonman. In addition, applicant Larinoff describes a wide variety of improvements in air-cooled heat exchangers in his prior U.S. Pat. Nos. 3,968,836; 4,129,180; 4,240,502 and 4,518,035 and in his pending U.S. patent applications. Such improvements relate to condensate removal, air removal, tube construction, cooling controls and the like. Various improvements in mechanisms for non-analogous technologies are disclosed in U.S. Pat. Nos. 2,924,438 to Malkoff; 3,922,880 to Morris and 4,220,121 to Maggiorana. Lastly, further improvements are disclosed in a paper identified by a date Jan. 1981 and entitled AIRCOOLED STEAM CONDENSER by Nuovo Pignone. Its publication date is not known.

As illustrated by the great number of prior patents and commercial devices, efforts are continuously being made in an attempt to improve air-cooled, vacuum steam condensers having particular utility in systems configuration with steam turbine cycles. Such efforts are being made to render condensers more efficient, reliable, inexpensive and convenient to use, particularly over a wider range of thermal operating conditions. None of these previous efforts, however, provides the benefits attendant with the present invention. Additionally, the prior disclosures and commercial devices do not suggest the present inventive combination of component elements arranged and configured as disclosed and claimed herein. The present invention achieves its intended purposes, objects and advantages over known devices through a new, useful and unobvious combination of component elements, with the use of a minimum number of functioning parts, at a reasonable or lower cost to manufacture, and by employing only readily available materials.

Therefore, it is an object of this invention to provide an improved steam power system comprising a turbine for converting steam energy into mechanical energy upon expansion of steam therein, a boiler for generating steam to be fed to the turbine, and a conduit arrangement coupling the boiler to the turbine input and then coupling the turbine exhaust to the boiler through air-cooled steam condensing mechanisms, the condensing mechanisms including a plurality of U-shaped tubes through which the expanded steam flows and is condensed; front header means at the input ends of the tubes located in the cooler ambient air exposed regions of the tubes for receiving exhaust steam from the turbine; rear header means at the output ends of the tubes located in the warmer unexposed regions of the tubes for receiving condensate and non-condensible gasses; and means in the rear headers to remove non-condensible gasses from the rear headers, the tubes being designed and constructed to protect the exposed tubes from freezing for lack of steam by employing a tube arrangement that normally flows a steam quantity from the input headers not only for its exposed single row condensing duty but also for a second row as well, the second row being located in the heated and protected unexposed center of the tube bundles thus insuring, when necessary, an additional supply of steam from the inner rows for the exposed tubes on both the top and bottom faces of the bundles which require the most protection.

It is yet a further object of this invention to properly and completely drain condensate from air-cooled steam condenser systems and protect them from freezing.

Lastly it is a further object of the present invention to completely remove undesired gasses from the terminal points of a steam condensing system namely the rear headers which are the cause of freezing problems, tube corrosion, and loss of thermal performance due to tube blanketing.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an improved steam powered system comprising a turbine for converting steam energy into mechanical energy upon expansion of steam therein, a boiler for generating steam to be fed to the turbine, and a conduit arrangement coupling the boiler to the turbine input and then coupling the turbine exhaust to the boiler through air-cooled steam condensing mechanisms, the condensing mechanisms including a plurality of U-shaped tubes through which the expanded steam flows and is condensed; front header means at the input ends of the tubes located in the cooler ambient air exposed regions of the tubes for receiving exhaust steam from the turbine; rear header means at the output ends of the tubes located in the warmer unexposed regions of the tubes for receiving condensate and non-condensible gasses; and means in the rear headers to remove non-condensible gasses from the rear headers, the tubes being designed and constructed to protect the exposed tubes from freezing for lack of steam by employing a tube arrangement that normally flows a steam quantity from the input headers not only for its exposed single row condensing duty but also for a second row as well, the second row being located in the heated and protected unexposed center of the tube bundles thus insuring, when necessary, an additional supply of steam from the inner rows for the exposed tubes on both the top and bottom faces of the bundles which require the most protection.

The invention may also be incorporated into an apparatus for condensing steam comprises a plurality of finned U-shaped tubes each having an input end and an output end, a plurality of front headers coupled with the input ends of the tubes and a plurality of rear headers coupled with the output ends of the tubes, the tubes being arranged in pairs with the output ends of each pair being located between its input end and a portion of the other tube of its pair for the thermal protection of the tubes adjacent to their output ends.

The invention may also be incorporated into an apparatus for use in condensing steam including input header means, output header means and a plurality of sets of tubes each in a U-shaped configuration and together forming a bundle, each tube having an input length terminating at an input end and an output length terminating at an output end and with a bight therebetween, each tube coupling a front header means with a rear header means and with the lengths arranged in four (4) rows, the input lengths constituting the first and fourth rows and with the output lengths constituting the second and third rows.

Lastly, the invention may be incorporated into an apparatus for use in condensing steam including input header means, output header means and a plurality of sets of tubes each in a U-shaped configuration, each tube having an input length terminating at an input end and an output length terminating at an output end and with a bight therebetween, each tube coupling a front header means with a rear header means and with the output ends of the tubes being positioned between the input lengths of each pair for the thermal protection thereof. The front header means for each tube pair and the rear header means for each tube pair are spaced from each other a distance equal to about half the length of each tube. The front and rear header means for each pair are located adjacent to the input and output ends of the tubes.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which:

FIG. 11 is the condensate drain end and FIG. 13 is the vent or non-condensible gas withdrawal end.

Similar referenced characters refer to similar parts throughout the several Figures.

DETAILED DESCRIPTION OF THE INVENTION

Overview

Figure 1:
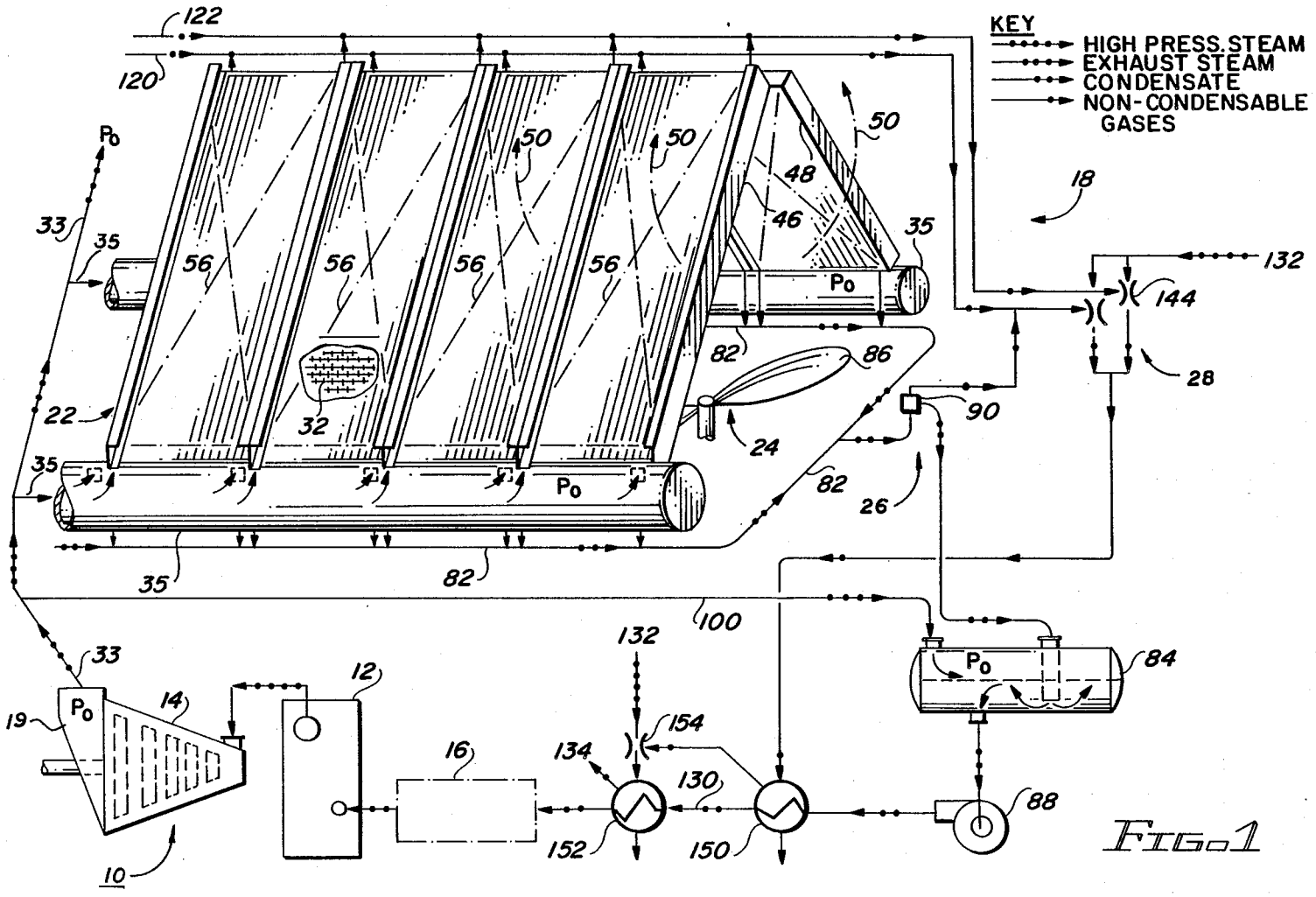
FIG. 1 is a simplified version of a steam power cycle that is a partially schematic and a partially diagrammatic illustration of a boiler, turbine, condensate pumps, steam jet air ejector set, coupling conduits and an air-cooled steam condenser. The condenser shown is an "A" frame configuration with steam and condensate flowing near horizontal in finned tubes installed transversely in bundle frames. It has mechanical forced draft with condensate drain to a storage tank via water leg seals.

With reference to FIG. 1, there is shown a power system 10 for converting thermal energy into mechanical energy. The system includes a boiler 12 for generating steam and a turbine 14 which expands the high pressure steam thereby converting its energy into shaft power. The waste steam 19 exhausted from the turbine is condensed in an air-cooled steam condenser 18 and the condensate is returned to the power cycle via conduits 16 and auxiliaries. The steam condensing mechanism 18 consists of sub-systems which may be considered as including a steam condensing system 22, an air moving system 24, a condensate drain system 26 and a gas removal vacuum system 28.

Steam Condensing System

The steam condensing mechanism employed in the preferred embodiment of the present invention consists of a main steam duct 33 feeding a steam supply duct 35 to which the steam condensing bundles 56 with their channel frames 148 are attached at the front header. The exhaust steam 19 flows nearly horizontally inside the bundles through a plurality of parallel finned U-shaped tubes 32 where it is condensed and the condensate runs in parallel with the steam toward the rear headers. In the disclosed preferred embodiment, the bundles are arranged in two (2) banks 46 and 48 in an A-frame configuration.

Figure 4:
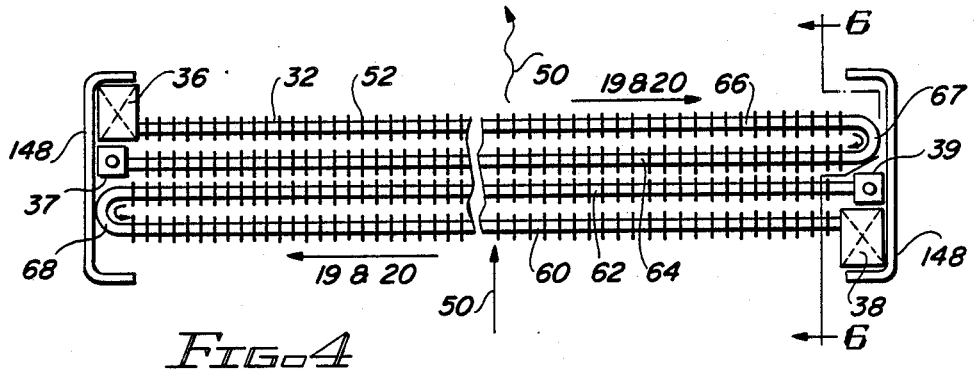
FIG. 4 is an end view of a typical bundle. It shows the U-tube loops comprising four (4) heat exchange rows that run transverse to the bundle frame.
Figure 5:
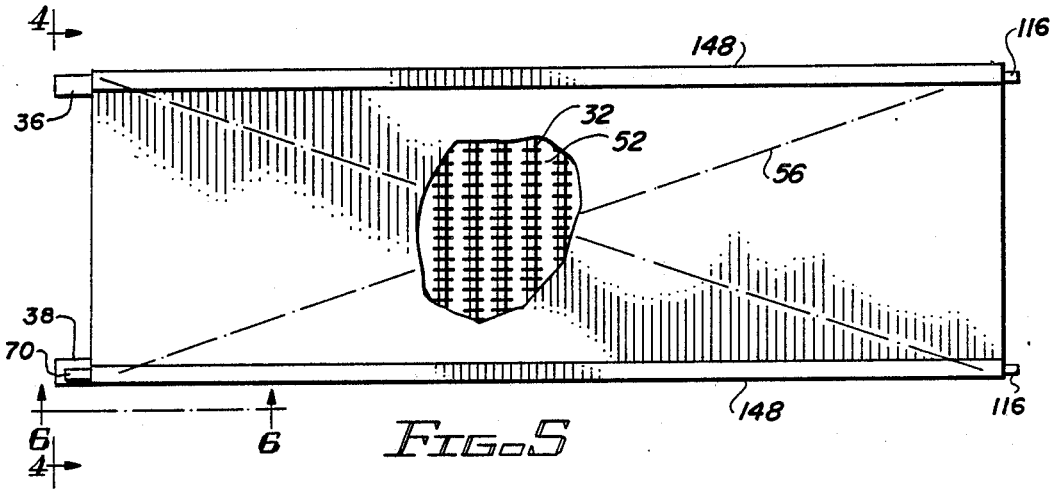
FIG. 5 is a plan view of a typical bundle. The tubes are sloped slightly from the horizontal to facilitate condensate drainage toward the rear headers.

The air-cooled steam condensing system employed in this invention may be considered as consisting of co-current air flow, two (2) pass steam flow, parallel condensate and steam flow inside the tubes, four (4) rows and a triangular pitch tube arrangement with the tubes installed nearly perpendicular to the bundle frame. The four (4) row bundle 56 consists of two (2) U-tubed elements 67 and 68 as shown in FIG. 4 with two (2) front headers 36 and 38 and two (2) rear headers 37 and 39. FIG. 26 shows an alternative arrangement with but a single front header 40. The two (2) faces of the bundles which are exposed to the ambient air have tube rows connected directly to the front headers respectively. Their rear headers and their corresponding tube rows are located inside the bundle. The tubes 32 are provided with fins 52 to facilitate and promote more efficient heat transfer. The heat transfer involves the flow of ambient air 50 over the finned tubes for cooling purposes to condense the steam into water. In its normal operation, the ambient air first contacts row 60 and then passes successively through rows 62, 64 and 66 where it is finally discharged as hot air back to the atmosphere.

Figure 6:
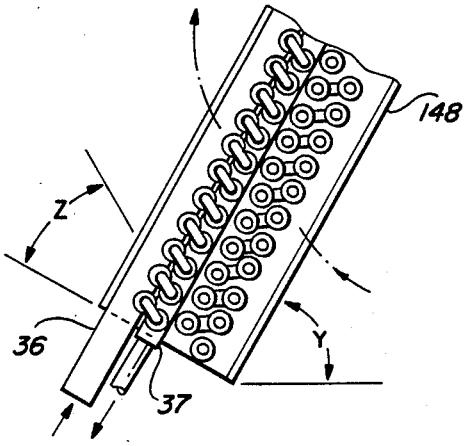
FIG. 6 is a side view of the bundle showing how the U-tubes are stacked in a triangular fashion and the return bends are positioned to drain by gravity flow to the rear headers.

The finned tubes are inclined from the horizontal sufficiently to provide gravity flow of the condensate to the ends of the tubes fastened to the rear header. There is a second inclination and that concerns the position of the U-tubes element in relation to the bundle frame. FIG. 6 shows the A-frame bundle inclined "Y" degrees from the horizontal while the U-tube element is inclined "Z" degrees from the end of the bundles. The angle "Y" can be decreased approaching the horizontal by increasing the "Z" angle another step in the triangular pitch configuration. This may be desirable for some installations. This bundle design can be operated from a vertical position to some minimum tilt angle Y which is required for proper condensate drainage.

One notable design feature of a cold weather steam condenser is the protection it offers its first row of tubes which are exposed to the ambient air, particularly the ends of the tubes which are also the terminal ends of the steam-travel path in some designs. The condensate flows through these tube ends and if there is no steam present, there is danger of freeing. To insure that there is steam present at the tube ends of the first row, some manufacturers have designed their bundle steam flow path so that the first row of tubes 60 are used as a conduit for additional steam to be condensed either in the second row 62 or in a vent/dephlegmator section which follows the primary condenser. If the first row 60 should experience excessively high air-side heat transfer rates for whatever reasons, then it condenses its normal steam quantity plus that additional quantity which was slated as blow-through steam for the higher row 62 or vent/dephlegmator sections. This blow-through steam acts as a safety steam-reservoir for the first row of tubes by giving it the additional protective steam supply it needs, when it needs it. The higher-row steam condensing surfaces 62 that have been robbed of steam are not adversely affected and the condensate that flows through them is in no danger of freezing since these tubes are located in the heated regions of the bundle.

Presently there are several bundle design arrangements on the market which provide blow-through steam for the first row. Some manufacturers employ separate vent/dephlegmator bundles that have their own fan cells while others simply install vent/dephlegmator section in the same bundle with the primary condenser. Still others use a U-tube design where the first row 60 is the primary condenser while the second row 62 of the U-tube may be thought of as a vent or secondary condenser. The blow-through steam normally slated for condensation in the second row, but condensed in the first row before it reaches the second row, provides the sought-after protection for the first row.

None of these designs have addressed a serious freeze problem that occurs in the top row 66 of the conventional A-framed bundle which is exposed to cold winter winds. A winter operating condition, for example, may require a 100 FPM controlled air movement entering the first row of tubes located in the bottom of the bundle. Yet an uncontrolled 10 MPH wind blowing over the top row of the exposed face of the bundles installed in an A-frame configuration is in essence an 880 FPM air movement across the finned tubes. This is 8.8 times the cooling air velocity that is required to do the steam condensing job safely. Experience has shown that wintry wind gusts blowing over the exposed top rows 66 of the bundles can cause severe freeze damage to their tubes.

The new steam condenser design of the instant invention offers added protection against freezing to the top rows of exposed tubes 66 that the other aforementioned condenser designs do not have. This protection is built into the bundle fluid flow paths as shown in FIG. 4. This is a U-tube, two-pass steam condenser which has its steam supply connected direct to both the first and last rows, 60 and 66, of tubes which are the most vulnerable to freezing. These two rows have the first call on the steam that enters the bundle. If one of these two rows has a higher heat transfer rate for reasons of a higher air flow rate and/or a lower air temperature, steam will automatically be drawn to its surfaces at the expense of the less favored row. For example, to protect itself from such a situation top row 66 will divert steam from bottom row 60 and in doing so will starve rows 62 and 64. If rows 62 and 64 do not receive any steam, this presents no problem since these rows are in the warm internal zone of the bundle where moisture and condensate inside the tubes will not freeze. Similarly, if bottom row 60 needs to protect itself it will automatically divert steam from top row 66 and in turn starve rows 62 and 64. Theoretically, it might be said that this four (4) row bundle heat-transfer surface automatically adjusts itself to become a one-plus (1+) row bundle when the external steam condensing conditions of rows 60 and 66 require this.

A further important advantage that this bundle design has is that it has a low internal steam pressure drop. It is low because its tube length is less than twice the bundle width and it has no secondary condensers, vent condensers, dephlegmators, etc. This low pressure drop remains the same for all practical purposes irrespective of the bundle length and/or fan diameter. This low internal steam pressure drop allows the steam turbine to operate at a lower exhaust pressure which in turn improves the plant thermal efficiency.

The superior benefits and results of the present invention are attained by the relationship of the front and rear headers and their associated U-shaped steam condensing tubes with fins as shown FIG. 4. The tubes are arranged in pairs with each tube having its associated input and output headers located adjacent to each other. The associated front and rear headers with each tube pair are positioned spaced from each other by a distance substantially equal to half the length of the tubes if they were elongated and not bent.

Each tube has a first or input length coupled at its input end to its front header. The input length extends to a bight in the tube and then returns parallel along a second or output length. The output length terminates at its output end at a rear header. The tubes of each pair are of similar construction but of opposite orientation in FIG. 4. The output end of each tube and its associated output header are in close proximity to its input end and its associated input header. Each output end and its associated header is located between the input lengths of the tubes of each pair and adjacent to its associated input headers. The tube lengths for each tube pair are thus located in four (4) rows with the second and third lengths, with lesser steam, between the first and fourth lengths, with greater steam. In this manner, the rear headers and the output lengths of their tubes are thermally protected from the colder ambient air by the input headers and their associated input tube lengths which ar exterior of the input tube lengths. The front headers and input lengths are exposed to greater blasts of coldness but have greater steam quantities available to them for withstanding such coldness.

Figure 16:
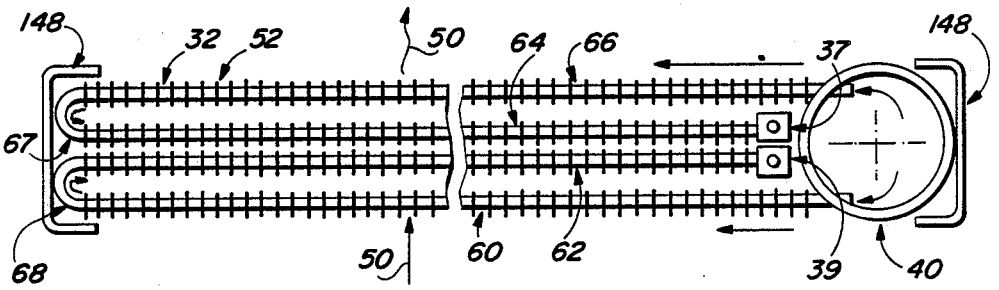
FIG. 16 is an end view of a bundle similar to FIG. 4 but constructed in accordance with an alternate embodiment of the invention, in which there is only one steam header per bundle.

An alternate embodiment of the present invention is shown in FIG. 16. According to that embodiment, the U-shaped finned tubes are also arranged in pairs. Their input ends, however, are coupled with a common front header means. The tubes have input ends and lengths and a bight and again double back to their output ends with output lengths parallel with the input lengths. The output ends terminate in rear headers located proximate each other as well as proximate the input header. The input ends of the tubes as well as the rear headers are all located proximate each other interior of the input ends, input lengths and their point of coupling with the front header so as the same thermal protection is afforded to the output lengths and output headers as is afforded in the primary embodiment of FIG. 4.

Air Moving System

The air moving system 24 employed in the disclosed preferred embodiments of this invention is the conventional industry type shown in the patent literature. It preferably employs either mechanical draft fans 86, natural draft or some combination of both. The fan arrangements can be either of the induced or forced draft type. In all cases the forced air flow 50 across the outside of the finned tubes is the cooling medium that condenses the steam inside the tubes. Appropriate air seals 164 are installed at the apex of the A-frame as required.

Condensate Drain System

Figure 10:
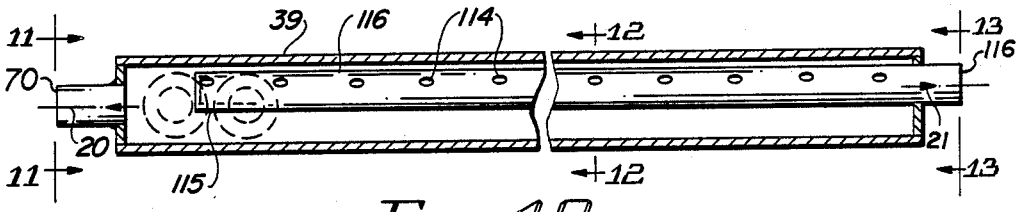
FIGS. 10, 11, 12 and 13 show a typical rear header with a suction sparger installed inside running its full length.
Figure 11:
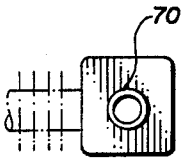
Figure 12:
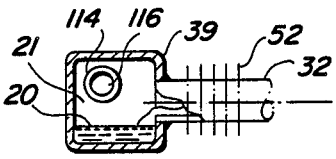
Figure 13:
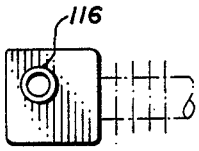
Figure 14:
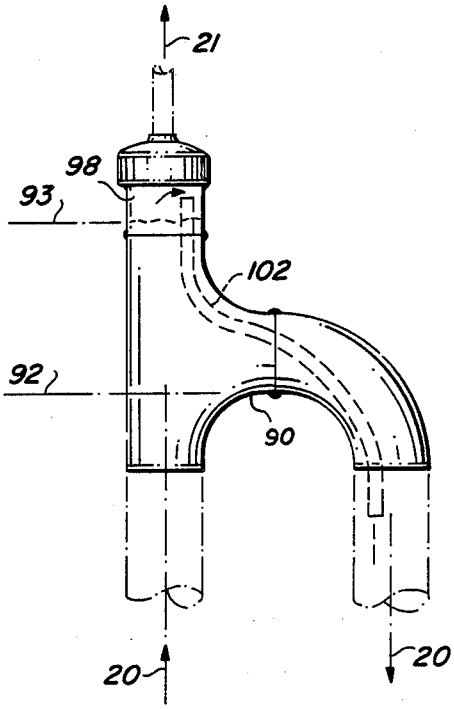
FIG. 14 is an elevation drawing of the hydraulic balance device installed in the main condensate system and identified as Item 90 in FIGS. 1 and 15.
Figures 7, 8, 9:
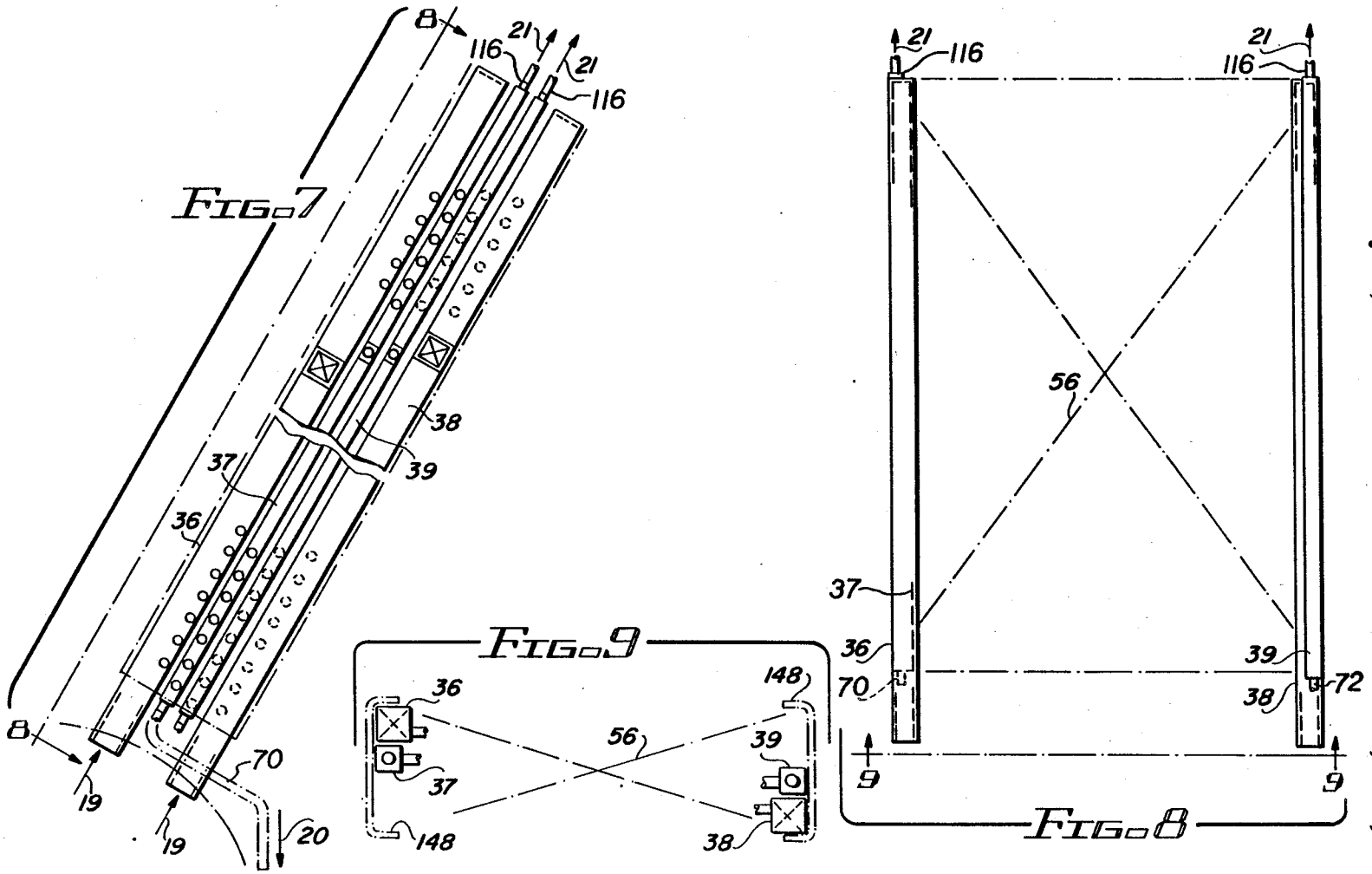
FIGS. 7, 8 and 9 are different views of the bundle front and rear headers. Each bundle has two (2) front headers and two (2) rear headers located adjacent to the bundle channel frames.
Figure 15:
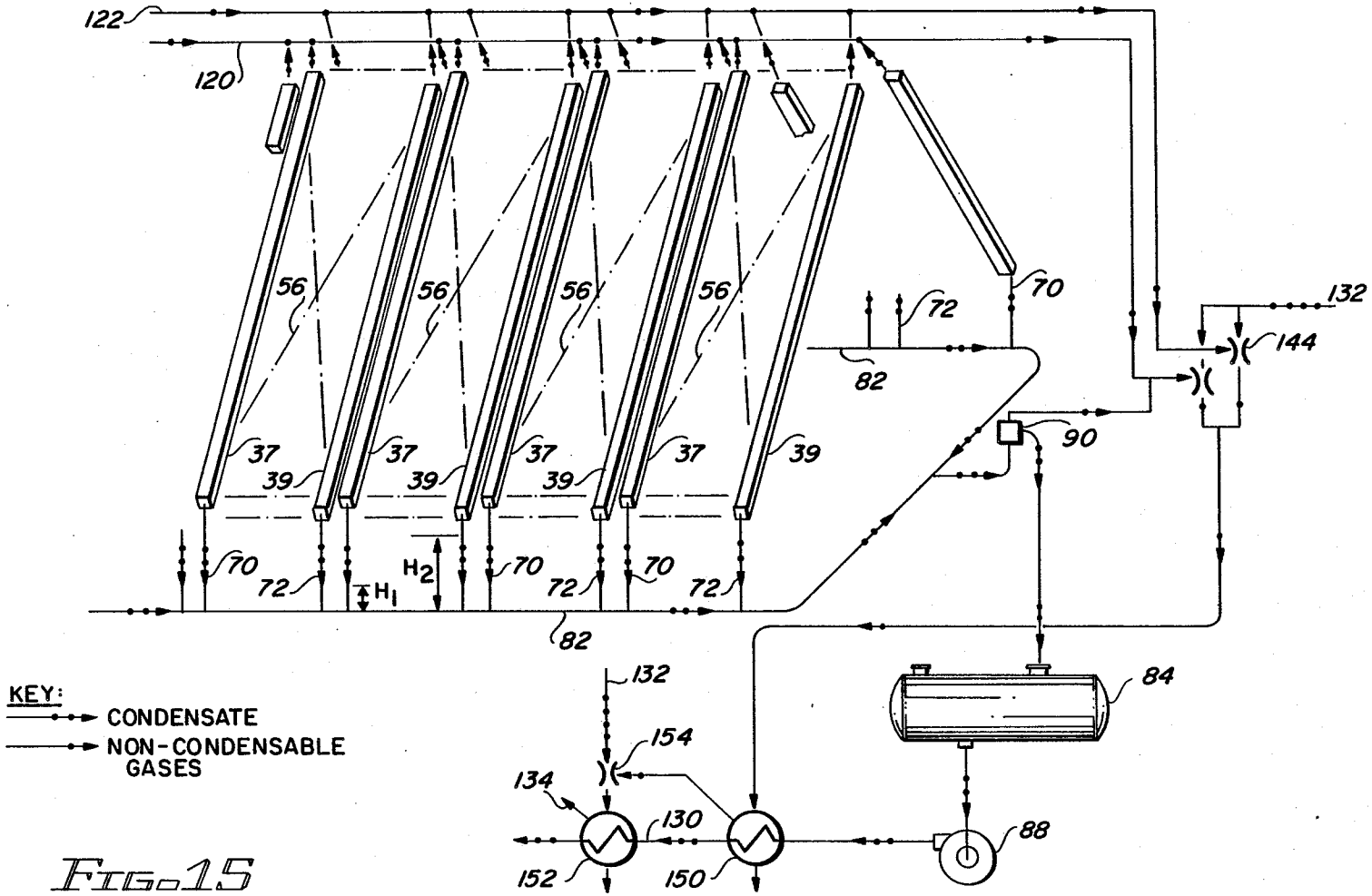
FIG. 15 is a flow diagram of the air-cooled steam condenser condensate drain system and the non-condensible gas removal system.
Figure 3:
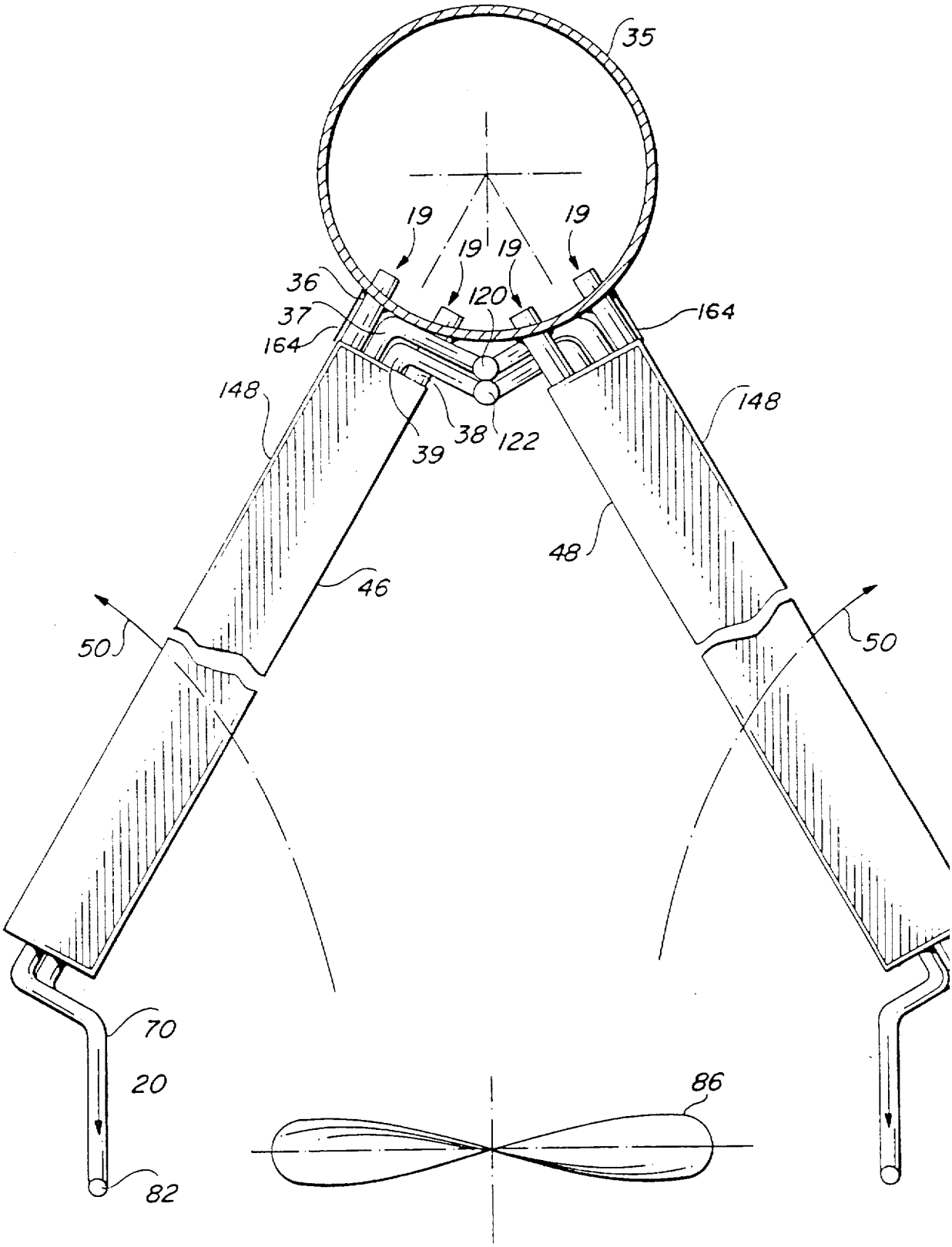

The condensate drain system starts at the bundle rear headers 37 and 39, FIG. 15. A detailed view of the rear header 39 is shown in FIG. 10. The condensate 20 flows from the rear header into a water leg 72 which is connected to a condensate manifold 82, FIGS. 1 and 15. From there it flows through an hydraulic balance device 90, FIG. 14, and into the condensate storage tank 84 by gravity. Condensate pumps 88 take suction from the storage tank and return the condensate back to the power cycle to repeat the process.

The bundle rear headers 37 and 39 operate at different steam pressures and therefore cannot be simply connected together. They are joined together at the condensate manifold 82 by means of water legs 70 and 72. The steam pressure in rear header 37 is greater than the steam pressure in rear header 39 and as a result its water leg height H-1 is less than water leg height H-2 for rear header 39. Note FIG. 15.

The water legs 70 and 72 must be freeze protected and the methods and means for doing this is the subject of another U.S. patent application Ser. No. 07/206,094 filed on 06/13/88 by the inventor of the instant application. The earlier patent shows a grouping of four (4) water legs, FIGS. 10, 11, 12, 13, 14 and 16 whereas this present design requires the grouping of only two (2) water legs, 70 and 72. The same principles apply to both cases.

The hydraulic balance device 90, FIGS. 1, 14 and 15 is the subject of the same patent application Ser. No. 07/206,094 referenced in the preceding paragraph. This device has several functions. The first is to provide a datum steam pressure from rear header 37 in chamber 98 against which the bundle rear header steam pressures and their corresponding water legs are hydraulically balanced. Its second function is to establish and maintain a predetermined static water level datum line 92 which insures that each water leg is operational and that the water level does not drop below this minimum otherwise its water sealing properties would be destroyed. In normal operation the water level would rise above datum 92, FIG. 14 and might approach a level such as 93, depending upon the flow quantities and friction pressure drop in the condensate piping. Vent tube 102 serves to purge chamber 98 of non-condensible gasses by the education process.

Gas Removal Vacuum System

One of the most important aspects of the present invention is the gas removal vacuum system employed in the bundles. It is the subject of two other U.S. patent applications, Ser. Nos. 07/206,094 and 07/206,095 filed on 06/13/88 by the same inventor. References should be made to those patent applications for an in-depth discussion of the sources of non-condensible gasses, the problems they present to the operation of the steam condenser and the alternative designs used by the industry to handle this problem.

All of the non-condensible gasses that are released by the condensing steam end up in the bundle rear headers 37 and 39. Each rear header has a suction sparger pipe 116 that runs the full length of the rear header as shown in FIG. 10. The suction sparger has a series of orifices 114 drilled along its entire length. The orifices are located so as to face a quiescent zone FIG. 12 in-between the finned tube openings, FIG. 10 with one orifice serving either one or a pair of tubes. The non-condensible gasses and vapors are "sucked out" from the rear header through these orifices 114 by the action of he steam jet air ejection equipment. Any condensate that enters the suction sparger drains by gravity through orifice 115 located at the bottom of the sparger pipe.

The gasses and vapors travel out of the suction spargers into a piping manifold 120 and 122, one for all the lower U-tube rear headers 39 and the other for all the upper U-tube rear headers 37. These rear headers cannot be tied together because they have different gas/vapor pressures due to their relative location in the bundle. The gas/vapors flow from the manifolds into the vacuum inducing first-stage ejectors 144 operated with motive steam 132. Note FIG. 15. The discharged mixture from the two (2) ejectors are now at the same pressure so that they can be mixed and piped direct to the inter-condenser 150. The residue is removed from the shell of the inter-condenser by a second stage ejector 154 which discharges its contents into the shell of after-condenser 152. The steam vapors are condensed by the after-condenser and the non-condensible gasses are discharged to the atmosphere 134. This air ejection package 130 is a conventional two-stage steam ejector unit with inter-condensers and after-condensers. Motor driven vacuum pumps with or without air ejectors could be readily substituted for the steam operated device shown.

As regards the drilled orifices of the suction sparger, they are of different diameters (i) along the length of the sparger, (ii) rear header sparger 37 compared to rear header sparger 39 (iii) amongst bundles themselves. They are different diameters for different reasons. In the first case the orifice openings near the open/exhaust end of the sparger will be slightly smaller than the orifices near the closed end because of internal frictional pressure drops through the length of the sparger pipe. In the second case the gas/vapor mixture pressure in rear header 37 is higher than the pressure in rear header 39. This requires different orifice diameters to achieve design flow rates. In the third case the bundles located close to the first-stage ejectors would normally tend to flow a larger quantity of gas/vapor than the bundles located further away at the end of the tower. This means that the bundles located close to the first-stage ejectors will have slightly smaller orifices than the bundles located at the far end of the tower. The object in all of these orifice drillings is to extract the same mass quantity of gas/vapor from each and every bundle in the tower, and similarly, to extract equal mass quantities of gas/vapor from each increment of rear header length. This gas/vapor extraction system is a fundamental improvement over the known present day systems.

The present day designs of gas/vapor extraction system do not have a suction sparger 116. They have an extraction pipe welded to the top of the rear header closure plate which would look similar to FIG. 13. This single pipe opening at the top of the rear header is expected to evacuate a rear header that may be about twenty (20) to over thirty (30) feet long in some designs. In reality what it is evacuating is mostly steam vapor blow-through that comes from the uppermost tubes of the bundle, close to the suction opening. The single suction opening at the top of the rear header cannot distinguish the non-condensible gasses from the steam vapor as it will move whatever fluid is closest to it. In the meantime the non-condensible gasses accumulate at the bottom of the rear headers rising upwards and then spill over into the ends of the condensing tubes themselves. In doing so they not only blanket heat transfer surfaces but they form pockets inside the tubes which are subject to freezing. The tubes have stagnant gas/vapor mixtures with no steam flow, and co-acting condensate in these regions will freeze. A single pipe opening at the top of the rear header cannot possibly reach down to relieve that situation; a full length suction sparger such as 116 can.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. An improved steam power system comprising a turbine for converting steam energy into mechanical energy upon expansion of steam therein, a boiler for generating steam to be fed to the turbine, and a conduit arrangement coupling the boiler to the turbine input and then coupling the turbine exhaust to the boiler through steam condensing mechanisms, the condensing mechanisms including:

a plurality of U-shaped tubes through which the expanded steam flows and is condensed;

front header means at the input ends of the tubes located in the cooler ambient air exposed regions of the tubes for receiving exhaust steam from the turbine;

rear header means at the output ends of the tubes located in the warmer unexposed regions of the tubes for receiving some additional steam and all of the condensate and non-condensible gasses; and means in the rear headers to remove noncondensible gasses from the rear headers, the tubes being designed and constructed to protect the exposed tubes from freezing for lack of steam by employing a tube arrangement that normally flows a steam quantity from the input headers not only for its exposed single row condensing duty but also for a second row as well, the second row being located in the heated and protected unexposed center of the tube bundles thus insuring, when necessary, an additional supply of steam from the inner rows for the exposed tubes on both the top and bottom faces of the bundles which require the most protection.

2. Apparatus for condensing steam comprising a plurality of finned U-shaped tubes each having an input end and an output end, a plurality of front headers coupled with the input ends of the tubes and a plurality of rear headers coupled with the output ends of the tubes, the tubes being arranged in pairs with the output ends of each pair being located between its input end and a portion of the other tube of its pair for the thermal protection of the tubes adjacent to their output ends.

3. For use in condensing steam, input header means, output header means, a plurality of sets of tubes each in a U-shaped configuration and together forming a bundle, each tube having an input length terminating at an input end and an output length terminating at an output end and with a bight therebetween, each tube coupling a front header means with a rear header means and with the lengths arranged in four rows, the input lengths constituting the first and fourth rows and with the output lengths constituting the second and third rows.

4. For use in condensing steam, input header means, output header means, a plurality of sets of tubes each in a U-shaped configuration and together forming a bundle, each tube having an input length terminating at an input end and an output length terminating at an output end and with a bight therebetween, each tube coupling a front header means with a rear header means and with the output ends of the tubes being positioned between the input lengths of each pair for the thermal protection thereof.

5. The apparatus as set forth in claim 4 wherein the front header means for each tube pair and the rear header means for each tube pair are spaced from each other a distance equal to about half the length of each tube.

6. The apparatus as set forth in claim 4 wherein all the front and rear header means for each pair are located adjacent to the input and output ends of the tubes.

7. In a device for condensing steam and for removing the non-condensible gasses therefrom, an improved conduit arrangement defining a gas/vapor path inside a bundle extending from an essentially vertical front-supply header to an essentially vertical rear-terminal header with condensing tubes extending essentially horizontally therebetween for steam as it moves from the front header to the rear and last header of the bundle where the non-condensible gasses terminate and collect as residue, the arrangement also including a suction sprayer pipe having a plurality of orifices located inside the rear header, the pipe having a length which spans the breadth of the rear header, the plurality of orifices being located in the immediate vicinity of the tubes with its orifices being positioned with respect thereto for the purpose of inducing the residue gasses leaving each steam condensing tube to flow directly into the sparger for removal from the rear header and then subsequent discharge from the system.

* * * * *

UNITED STATES PATENT AND TRADEMARK OFFICE

CERTIFICATE OF CORRECTION

PATENT NO. : 4,926,931

DATED : May 22, 1990

INVENTOR(S) : Michael W. Larinoff

It is certified that error appears in the above—identified patent and that said Letters Patent is hereby corrected as shown below:

Line 31 of Column 12 after "suction" change "sprayer" to --sparger--

Figure 2:
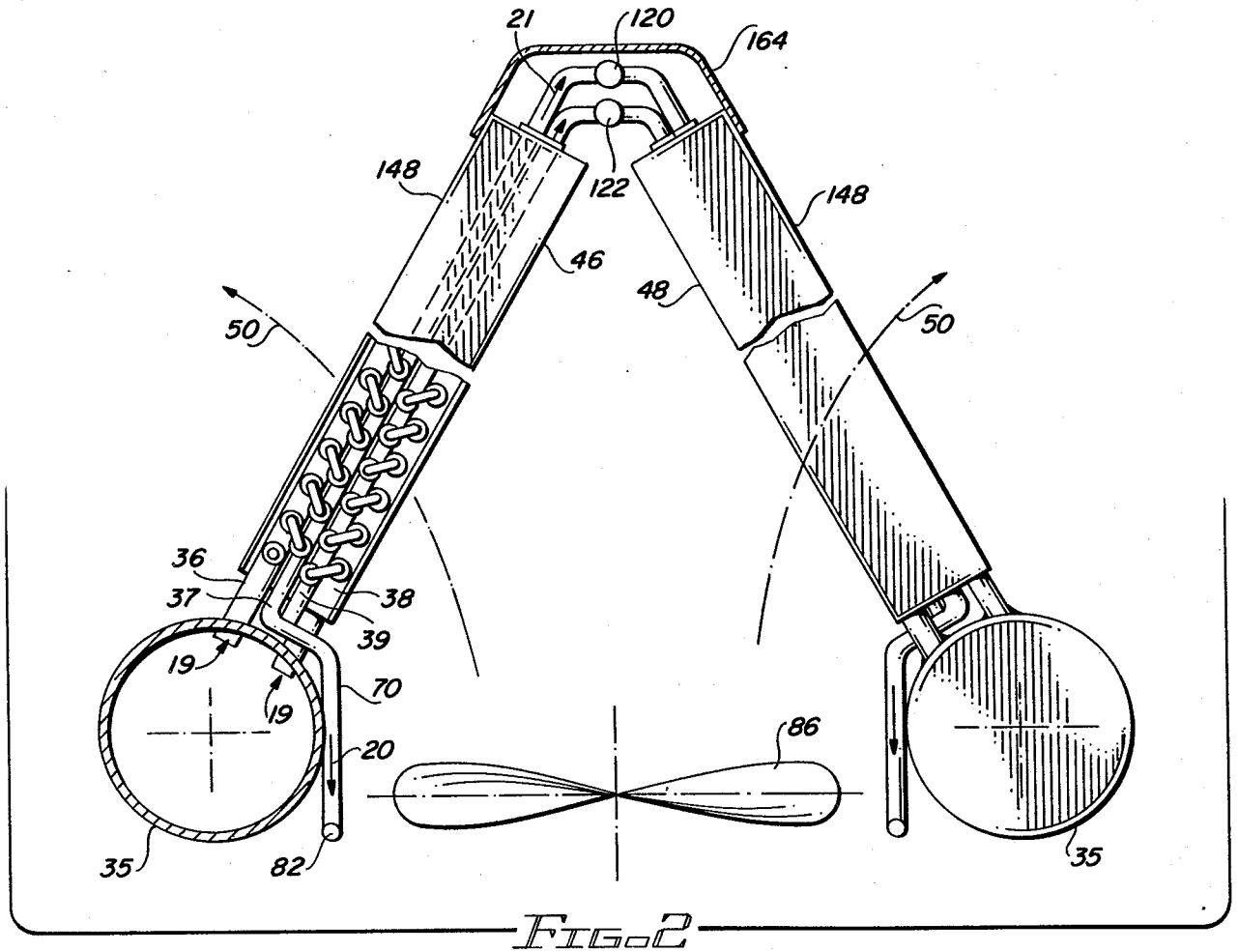
FIG. 2 is an elevation drawing with a small vertical section through a bundle showing the tube arrangement and a forced draft fan in the middle serving both banks. The steam supply duct is located at the bottom of the bundles.
Figure 3:
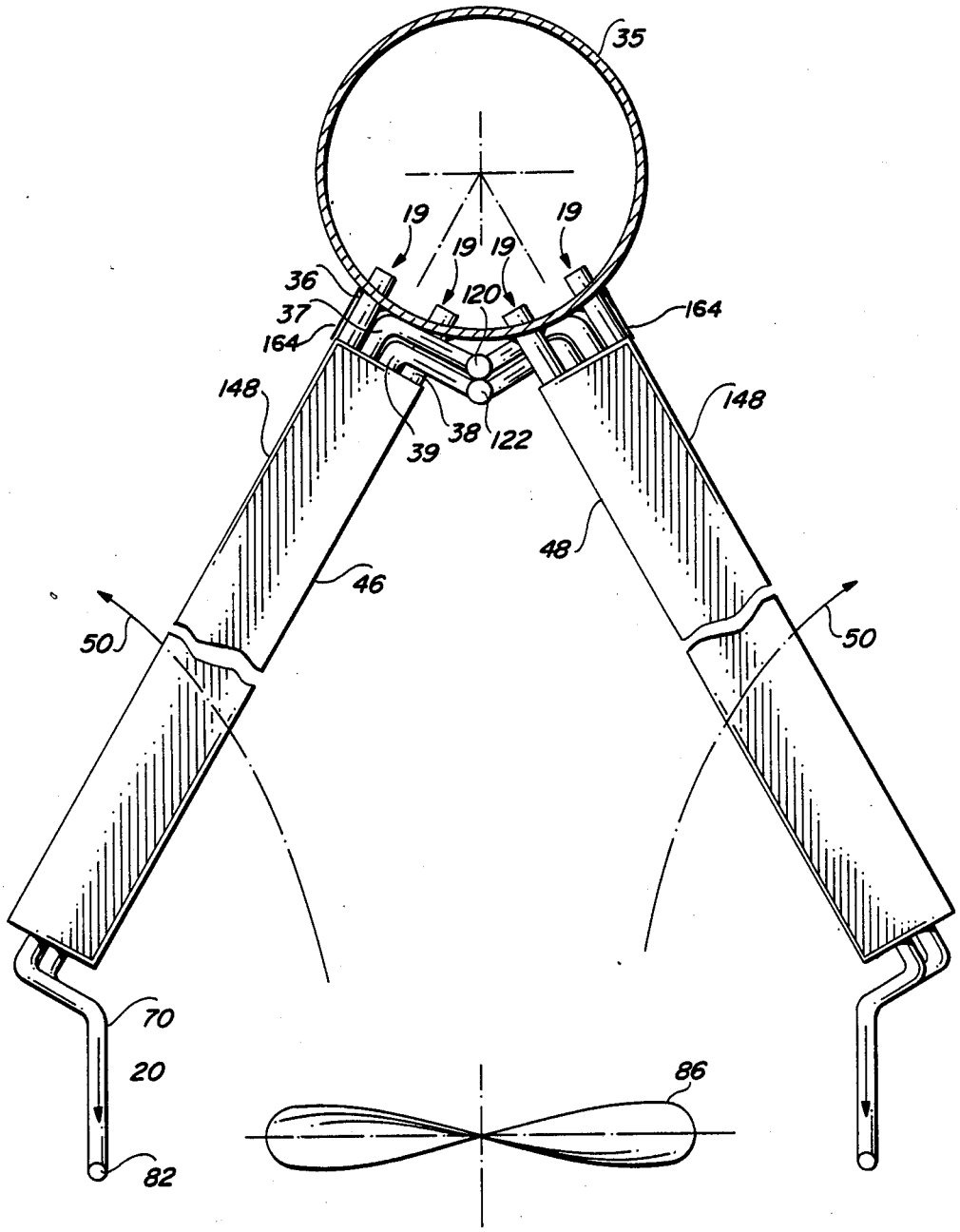
FIG. 3 is similar to FIG. 2 except the steam supply duct is located at the apex of the A-frame.

In the drawings, delete the second sheet of figure 2, sheet 2 of 7 and and substitute the attached sheet to show figure 3, sheet 3 of 7.

Signed and Sealed this

Thirtieth Day of July, 1991

*Attest:*

*Attesting Officer*

HARRY F. MANBECK, JR.

*Commissioner of Patents and Trademarks*